United States Patent [19]

Rezac et al.

[11] Patent Number: 5,075,657

[45] Date of Patent: Dec. 24, 1991

[54] UNITARY BREAKER ASSEMBLY FOR A CIRCUIT BREAKER

[75] Inventors: Willard J. Rezac; Thomas A. Edds, both of Lincoln, Nebr.; James Early; Martin Donnellan, both of Ballinasloe, both of Northern Ireland; Lowell D. Smith, Crete, Nebr.

[73] Assignee: Square D Company, Palatine, Ill.

[21] Appl. No.: 553,936

[22] Filed: Jul. 17, 1990

Related U.S. Application Data

[62] Division of Ser. No. 374,037, Jun. 29, 1989, Pat. No. 4,968,863.

[51] Int. Cl.[5] ..... H01H 75/00

[52] U.S. Cl. ..... 335/6; 335/21; 335/202

[58] Field of Search ..... 335/21-23, 335/6, 35, 167-176, 188-191, 202

[56] References Cited

U.S. PATENT DOCUMENTS

| | | | |
|---|---|---|---|
| 4,166,988 | 9/1979 | Ciarlia et al. | 335/9 |
| 4,342,974 | 8/1982 | Nakano et al. | 335/10 |
| 4,855,549 | 8/1989 | Toda et al. | 335/16 |

*Primary Examiner*—Leo P. Picard
*Assistant Examiner*—Lincoln Donavan
*Attorney, Agent, or Firm*—Larry I. Golden; Jose W. Jimenez

[57] ABSTRACT

An assembly frame having first and second frame plates secures the movable parts of a breaker assembly together for ready assembly of the breaker assembly in a housing. A pivot pin supports the trip lever between the frame plates. The movable contact carrying blade has an elongated hole through which the pivot pin passes, the elongate hole forming a floating point for the pivot pin.

5 Claims, 3 Drawing Sheets

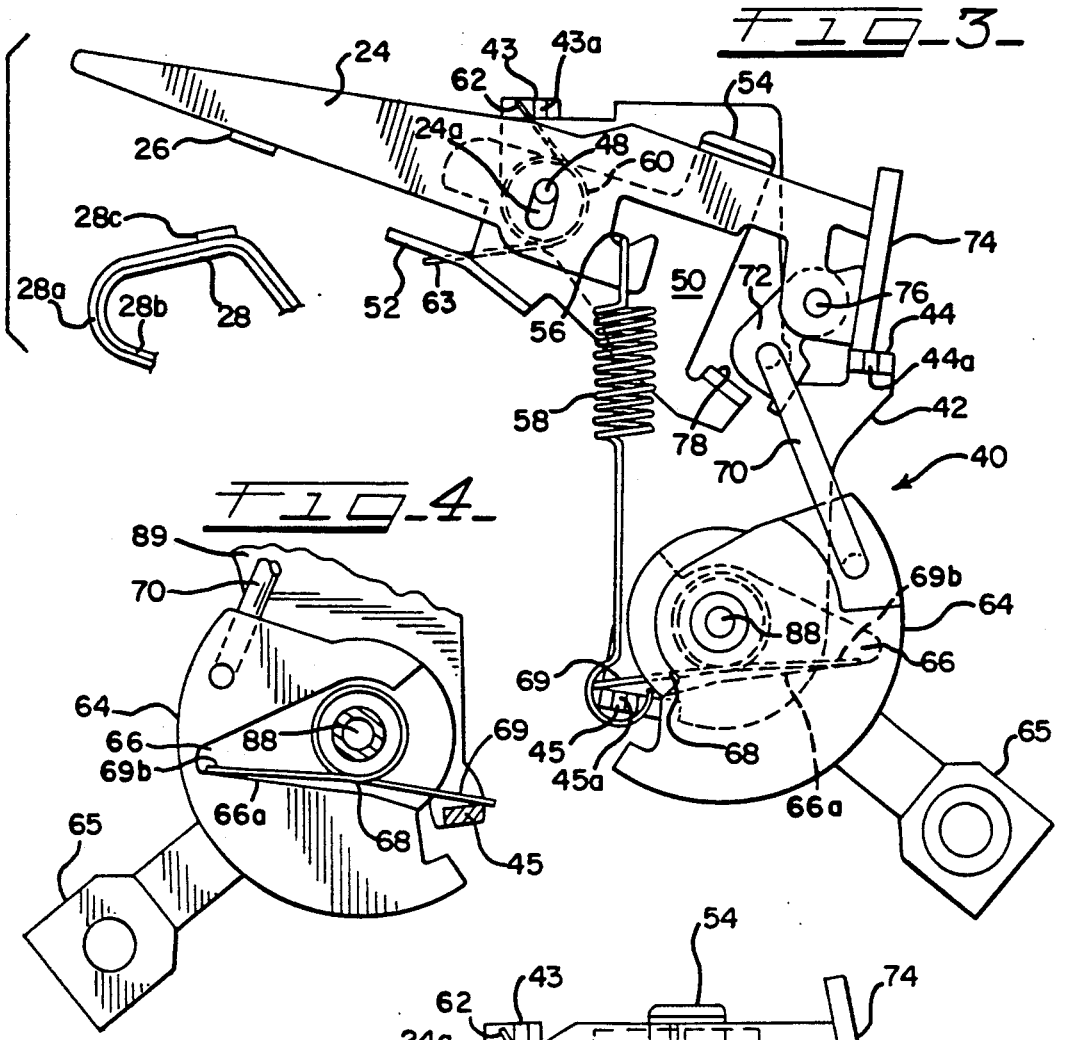
FIG. 3
24
43
43a
62
54
26
24a
48
60
28c
74
28a
28b
28
52
63
50
72
76
44
56
44a
58
42
78
70
40
FIG. 4
89
70
69b
64
88
66
69
64
66
88
69
69b
45
45a
68
65
66a
66a
68
45
65
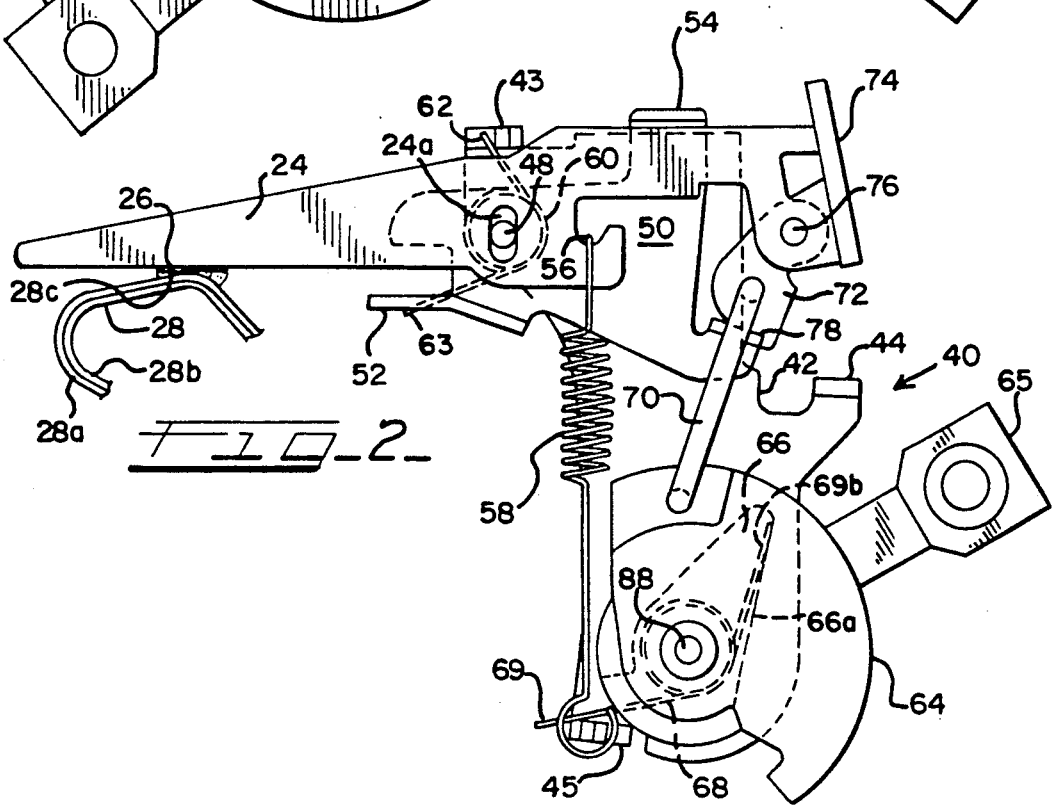
54
43
74
62
24a
48
60
24
26
76
50
56
28c
72
28
78
63
44
40
28b
52
42
65
28a
70
FIG. 2
66
58
69b
88
66a
69
64
45
68

UNITARY BREAKER ASSEMBLY FOR A CIRCUIT BREAKER

This is a divisional of copending application(s) Ser. No. 07/374,037 filed on June 29, 1989, now U.S. Pat. No. 4,968,863.

CROSS REFERENCE TO RELATED APPLICATION

This application is related to application Ser. No. 373,380, filed 6/29/89, entitled A METHOD OF ASSEMBLING, A UNITARY BREAKER ASSEMBLY FOR A CIRCUIT BREAKER, in the name of W. Rezac, and assigned to Square D Company, the assignee of the present invention.

DESCRIPTION

1. Technical Field

The invention relates to circuit breakers and, more particularly, to a circuit breaker having a unitary breaker mechanism which facilitates automated assembly of the circuit breaker.

2. Background Prior Art

Circuit breakers are utilized to break an electrical circuit between a source of electricity and an electrical load in response to an over-current condition.

Circuit breakers typically are contained in a housing and include a stationary contact coupled to the electrical load. Circuit breakers typically further include a breaker assembly including a blade carrying a movable contact coupled to the electrical source and a spring for biasing the movable contact away from the stationary contact. The breaker assembly further includes a releasable latch mechanism which opposes the spring bias and maintains the movable contact in a contacting relationship with the stationary contact, permitting current to flow between the electrical source and the electrical load.

The latch mechanism includes a trip lever which, when actuated, releases the latch mechanism, permitting the spring bias to move the movable contact away from the stationary contact, thereby preventing current flow between the electrical source and the electrical load.

Prior breaker assemblies often were not self contained and required points of attachment with the housing. This made preassembly of the breaker assembly difficult because the breaker assembly would come apart unless held together by the housing.

Actual assembly of the breaker assembly has been difficult to automate because many assembly steps had to be performed along all three orthogonal axes. Automated assembly of the circuit breaker itself has also been difficult because of the requirement of attaching elements of the breaker assembly to the housing.

In addition, the cross-sectional area of the blade was a current capacity limiting element. In order to increase the current carrying capability of the circuit breaker, one would attempt to increase the cross sectional area of the blade.

Many prior blades were of a springboard design with opposing, upwardly directed side members. With the springboard design, increasing the cross sectional area was difficult because to do so would change the entire geometry of the blade.

The present invention is provided to solve these and other problems.

SUMMARY OF THE INVENTION

It is an object of the invention to provide a unitary breaker assembly for a circuit breaker for alternatively making and breaking contact with a stationary contact.

According to the invention, the unitary breaker assembly comprises first and second spaced frame surfaces defining an assembly frame, and a cam pivotally disposed between the frame surfaces. The cam is rotatable between an upward position and a downward position and includes an operating handle extending outwardly therefrom.

The unitary breaker assembly further comprises means for biasing the cam toward the downward position, a pivot pin joining the frame plates and a blade pivotally mounted on the pivot pin between the frame plates. The blade has a contact end and an opposing flag end. The contact end is adapted for contact with the stationary contact, and the blade is pivotable between a contacting position wherein the contact end is in contacting relationship with the stationary contact, and a non-contacting position wherein the contact end is in a non-contacting relationship with the stationary contact.

The breaker assembly still further comprises a trip lever pivotally mounted on the pivot pin between the frame plates, a pawl pivotally joined to the flag end of the blade, a link having a first end pivotally joined to the cam and a second end pivotally joined to the pawl and a toggle spring coupled between the blade and the assembly frame.

Rotation of the cam toward the upward position operates on the pawl by means of the link to move the blade to the contacting position and to move the pawl into engagement with the trip lever to maintain the blade in the contacting position.

The trip lever further includes an actuator surface radially spaced from the pivot pin such that a force applied to the actuator surface when the cam is in the upward position rotates the trip lever, moving the trip lever out of engagement with the pawl, thereby releasing the blade and permitting the toggle spring to move the blade toward the open position.

It is comprehended that the cam biasing means comprises a cam spring disposed between the cam and the assembly frame.

It is further comprehended that the trip lever is disposed adjacent to the blade and that the blade comprises a tapered plate on edge.

It is yet further comprehended that the blade includes an elongated slot forming a floating point for receiving the pivot pin. The pivot pin contacts the slot to operate as a fulcrum only when the pawl is not in engagement with the trip lever. The operation of the pivot pin as a fulcrum causes the toggle spring to bias the blade toward the non-contacting position, and the absence of the pivot pin operating as a fulcrum causes the toggle spring to bias the blade toward the contacting position.

In accordance with another aspect of the invention, the unitary breaker assembly is disposed in a circuit breaker housing.

Other features and advantages of the invention will be apparent from the following specification taken in conjunction with the following drawings.

BRIEF DESCRIPTION OF DRAWINGS

FIG. 2 is a view of a unitary breaker assembly according to the invention in a contacting position;

FIG. 3 is a view of the unitary breaker assembly of FIG. 2, shown in a non-contacting position;

FIG. 4 is a view of a cam as viewed from behind the unitary breaker assembly of FIGS. 2 and 3.

DETAILED DESCRIPTION

Figure 1:
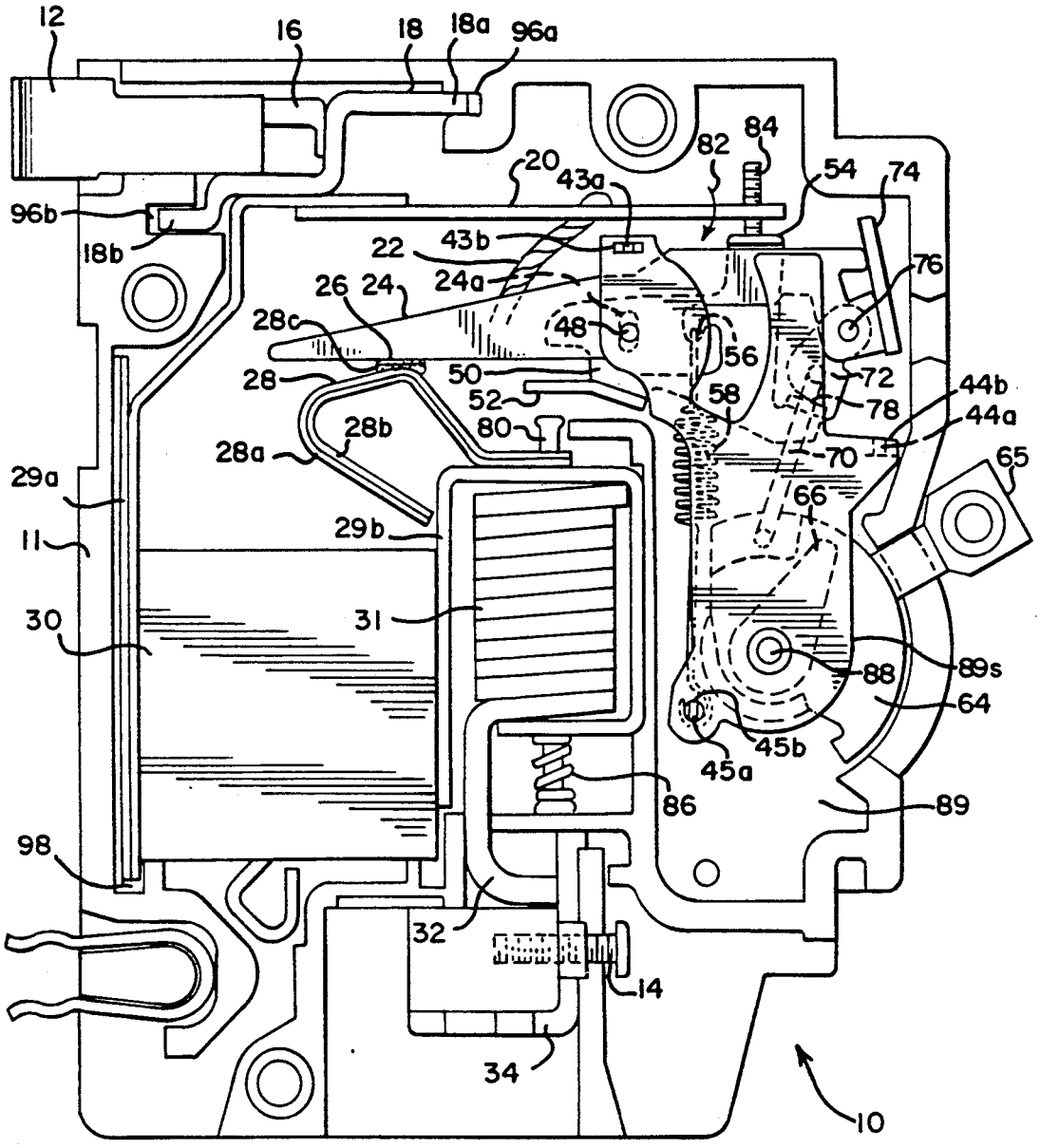
FIG. 1 is a view of a circuit breaker according to the invention.

While this invention is susceptible of embodiments in many different forms, there is shown in the drawings and will herein be described in detail, a preferred embodiment of the invention with an understanding that the present disclosure is to be considered as an exemplification of the principles of the invention and is not intended to limit the broad aspects of the invention to the embodiment illustrated.

A circuit breaker 10 is illustrated in FIG. 1.

An additional description of general aspects of a circuit breaker can be found in the following patents, the specifications of which are specifically incorporated herein by reference:

(a) Westermeyer, U.S. Pat. No. 4,617,540, entitled "Automatic Switch, Rail-Mounted", (b) Westermeyer, U.S. Pat. No. 4,614,928, entitled "Automatic Switch with an Arc Blast Field", (c) Westermeyer, U.S. Pat. No. 4,609,895, entitled "Automatic Switch with Integral Contact Indicator", and (d) Westermeyer, U.S. Pat. No. 4,608,546, entitled "Automatic Switch with Impact-Armature Tripping Device".

The circuit breaker 10 has a housing 11 and includes a line terminal 12 for coupling to a source of electricity (not shown) and a load terminal 14 for coupling to a load (not shown). A current path is established between the line terminal 12 and the load terminal 14 which includes as elements a line conductor 16, a bimetal support 18, a bimetal thermal element 20, a braided pigtail 22, and a blade 24 including a movable contact 26.

Continuing from the movable contact 26, the current path includes a stationary contact 28, a coil 31, a conductive line 32, a load conductor 34, and ultimately the load terminal 14.

The blade 24 is illustrated in FIG. 1 in a closed position, wherein the movable contact 26 contacts the stationary contact 28. As discussed below with respect to FIG. 3, the blade 24 is pivotable to an open position, wherein the movable contact 26 is spaced from the stationary contact 28, preventing current to flow between the movable contact 26 and the stationary contact 28. The stationary contact 28 comprises a copper layer **28*a* laminated to a steel layer 28*b* with a silver/graphite composition contact 28*c* welded to the copper layer 28*a***.

The blade 24 is an element of a unitary breaker assembly generally designated 40 which controls the position of the blade 24 relative to the stationary contact 28.

The circuit breaker 10 also includes a line-side arc arresting plate **29*a*, a load side arc arresting plate 29*b* and a stack of deionization plates, or arc stack, 30, which cooperate to break an arc formed when the circuit breaker 10 opens under load. The specific operation of the line- and load-side arc arresting plates 29*a* and 29*b*, respectively, in conjunction with the arc stack 30** is disclosed in greater detail in the above incorporated patents.

The unitary breaker assembly 40 is illustrated in FIG. 2 with the blade 24 in the closed position in contact with the stationary contact 28.

The unitary breaker assembly 40 includes a first frame plate 42 which forms a first frame surface. The first frame plate 42 includes first, second and third upright members 43, 44, 45, respectively. A pivot pin 48 extends upwardly through a hole in the first frame plate 42. A trip lever 50 is mounted on the pivot pin 48 through a trip lever opening. The trip lever 50 includes a solenoid actuator surface 52 and a bimetal actuator surface 54. The blade 24 includes an elongated slot **24*a* for receiving the pivot pin 48. The blade 24 further includes a notch 56 to which a first end of a toggle spring 58** is attached.

A latch spring 60 is disposed on the pivot pin 48 between the trip lever 50 and the blade 24. The latch spring 60 includes a first .end 62 which engages the first upright member 43 and a second end 63 which engages the solenoid actuator surface 52 of the trip lever 50. The latch spring 60 provides a counter clockwise bias to the trip lever 50.

A cam 64 has an operating handle 65 and further includes a recessed portion 66 in which a cam spring 68 is placed, as discussed in greater detail below with reference to FIG. 4. A first cam spring end **69*a* extends out of the recessed portion 66 and engages the third upright member 45. A second cam spring end 69*b* is retained in the recessed portion 66. The cam spring 68 maintains a clockwise bias of the cam 64 as viewed in FIG. 2**.

A link 70 connects the cam 64 to a pawl 72. The pawl 72 is pivotally connected to a flag end 74 of the blade 24 by a shoulder rivet 76.

The trip lever 50 further includes an engaging surface 78 which engages the pawl 72.

When in the closed position, as illustrated in FIG. 2, the movable contact 26 is in a contacting relationship with the stationary contact 28. The shoulder rivet 76 operates as a fulcrum on the blade 24, causing the toggle spring 58 to securely maintain the movable contact 26 in contact with the stationary contact 28.

Referring again to FIG. 1, the blade 24 can be moved to the open position by operation of either the bimetal thermal element 20 or by a spring loaded rod 80 disposed within the coil 31. The breaker can also be operated by means of the operating handle 65.

As current passes between the line terminal 12 and the load terminal 14, it passes through the bimetal thermal element 20. As is well known in the art, the current causes the bimetal thermal element 20 to heat, and the heat causes the bimetal thermal element 20 to deflect downwardly in the direction of arrow 82. The extent of the deflection depends on the magnitude of the heating of the bimetal thermal element 20, and hence depending upon the magnitude and length of time of the current passing between the line terminal 12 the load terminal 14.

When the bimetal thermal element 20 deflects sufficiently, a calibration screw 84 engages the bimetal actuator surface 54 of the trip lever 50, causing the trip lever 50 to rotate clockwise about the pivot pin 48 and against the bias of the latch spring 60, tripping the circuit breaker 10, as discussed in greater detail below.

The circuit breaker 10 can also be tripped by the coil 31. The rod 80 is downwardly biased by a solenoid spring 86. Current passing between the line terminal 12 and the load terminal 14 passes through the coil 31, establishing an electromagnetic field affecting the rod 80. When the electromagnetic force acting on the rod 80 exceeds the biasing force of the solenoid spring 86, the rod 80 moves upwardly to engage the solenoid actuator surface 52, causing the trip lever 50 to rotate clockwise, tripping the circuit breaker 10, as discussed below.

Referring again to FIG. 2, when either the bimetal thermal element 20 or the rod 80 cause the trip lever 50 to rotate clockwise, the engaging surface 78 of the trip lever 50 moves away from engagement with the pawl 72. When the engaging surface 78 moves away from engagement with the pawl 72, biasing from the handle spring 68 causes the cam 64 to rotate clockwise. As the cam 64 rotates clockwise, the cam 64 pulls downwardly upon the link 70, causing the pawl 72 to rotate counter clockwise about the shoulder rivet 76.

As illustrated in FIG. 3, when the pawl 72 is released from engagement with the engaging surface 78, the blade 24 moves downwardly at its right side, initially causing the pivot pin 48 to engage the upper surface of the elongated hole 24, which operates as a floating point. The pivot pin 48 then operates as a fulcrum about which the blade 24 rotates, causing the toggle spring 58 to move the movable contact 26 away from the stationary contact 28, thus opening the circuit.

In the event that the operating handle 65 is locked in the upward or on, position, and either bimetal thermal element 20 or the rod 80 causes the trip lever 50 to rotate clockwise, the link 70, which is under compression between the cam 64 and the pawl 72, causes the pawl 72 to rotate clockwise about the shoulder rivet 76, again releasing the engaging surface 78 from engagement with the pawl 72. When the engaging surface 78 no longer engages the pawl 72, the blade 24 lowers, again causing the pivot pin 48 to operate as a fulcrum about which the blade 24 rotates, permitting the toggle spring 58 to again move the movable contact 26 away from the stationary contact 28.

The cam 64 is shown from its reverse side in FIG. 4 to better illustrate the recessed portion 66 and the cam spring 68.

The handle spring 68 is centered on a cam axis 88. The second cam spring end 69*b* is held against a wall 66*a* of the recessed portion 66. The first cam spring end 69*a* is held against the third upright member 45 under torsion loading. The loading of the cam spring 68 biases the cam 64 and the operating handle 65 in the downward position.

Figure 5:
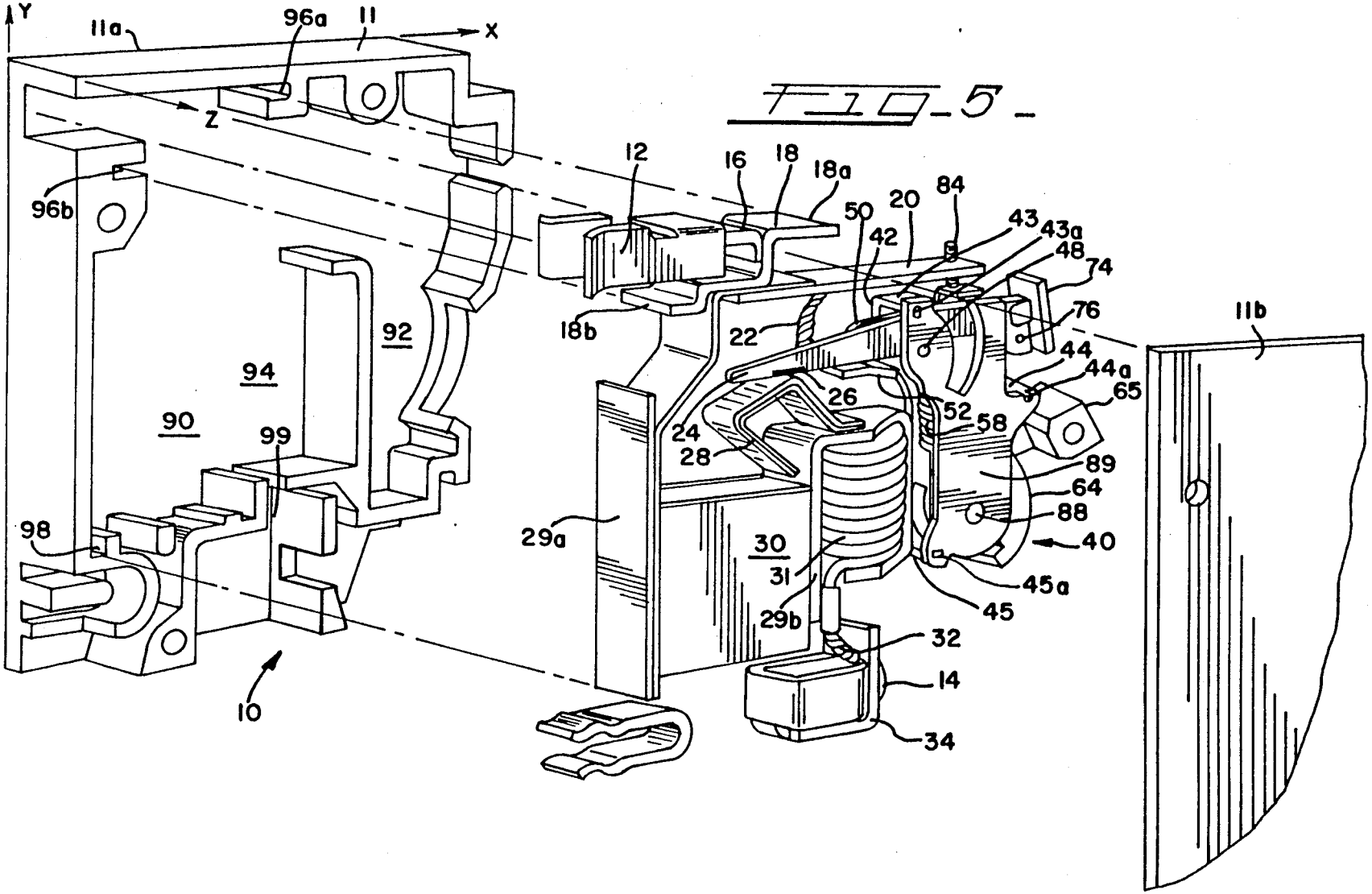
FIG. 5 is an exploded perspective of the circuit breaker of FIG. 1.

The circuit breaker 10 is illustrated in an exploded perspective view in FIG. 5. The first, second and third upright members 43, 44, 45 of the first frame plate 42 terminate with connecting tabs 43*a*, 44*a*, 45*a*, respectively. A second frame plate 89 forms a second frame surface 89*s* which includes corresponding tab receiving openings 43*b*, 44*b*,45*b*. The tab receiving openings 43*b*, 44*b*, 45*b*, receive and provide an interference fit with the connecting tabs 43*a*, 44*a*, 45*a* to secure the first frame plate 42 to the second frame plate 89. The first frame plate 42 cooperates with the second frame plate to form an assembly frame. In the preferred embodiment the first and second frame plates 42, 89, respectively, are separate pieces; however it is to be understood that the assembly frame could be formed from of a single piece folded over to form the opposing frame surfaces without departing from the spirit and scope of the present invention.

With the first frame plate 42 secured to the second frame plate 89, all elements of the unitary breaker assembly 40 are secured together.

As illustrated in FIG. 5, operating elements of the circuit breaker 10 can simply be dropped into the circuit breaker housing, and require no special attachment thereto.

The housing 11 has a base 11*a* and a cover 11*b*. The base 11*a* defines an x-y plane and includes internal walls directed perpendicular to the base 11*a* along a z-axis. The internal walls define generally an arc stack section 90, a unitary breaker assembly section 92 and coil section 94.

End portions 18*a* and 18*b* of the bimetal support 18 are slid into and retained within respective bimetal support slots 96*a* and 96*b*. The line-side arc arresting plate 29*a* is slid into and retained within an arc runner slot 98. The unitary breaker assembly 40 is then simply placed in the unitary breaker assembly section 92, and requires no attachments to the housing 11. The load conductor 34 is slid into and retained in a load conductor slot 99.

The blade 24 is a tapered plate on edge, operating structurally as a beam so as to prevent flexing. If additional current carrying capacity is required, the width of the blade 24 is simply increased.

Thus it can be seen that a unitary breaker assembly has been provided which can be preassembled and which requires no attachments to secure it within a circuit breaker housing. In addition, assembly of the unitary breaker assembly can readily be automated because the assembly steps are performed along a single axis.

In addition, it can be seen that a circuit breaker has been provided which incorporates the unitary breaker assembly and assembly and which can also be readily automated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A unitary breaker single pole assembly for use in a circuit breaker comprising:
   - a frame defining a pair of spaced apart frame plates rigidly secured together;
   - contact carrying blade means pivotally mounted between said frame plates for movement between an opened and a closed position;
   - spring means for normally urging said blade to said opened position;
   - toggle means urging said blade to said closed position against the force of said spring means;
   - trip means for collapsing said toggle means; and
   - all of said means being wholly supported for mechanical operation between said frame plates.

2. The breaker assembly of claim 1 wherein said toggle means includes a cam having an operating handle and said trip means includes a trip lever and a link coupling said cam to said trip lever.

3. The breaker assembly of claim 2 wherein said trip lever has a solenoid actuator surface and a thermal element actuator surface.

4. The breaker assembly of claim 3, further including a pivot pin mounted between said frame plates and wherein said blade is mounted on said pivot pin and includes an elongated hole forming a floating point for said pivot pin.

5. A unitary breaker single pole assembly for use in a circuit breaker comprising:

a pair of spaced apart frame plates rigidly secured together;

pivot pin means mounted between said frame plates;

contact carrying blade means including a blade mounted on said pivot pin means between said frame plates for movement between an opened and a closed position, said blade including an elongated pole forming a floating point for said pivot pin;

spring means for normally urging said blade to said opened position;

toggle means, including a cam having an operating handle, urging said blade to said closed position against the force of said spring means;

trip means, including a trip lever and a link coupling said cam to said trip lever, for collapsing said toggle means, said trip lever having a solenoid actuator surface and a thermal element actuator surface; and all of said means being wholly supported for mechanical operation between said frame plates.

* * * * *